US006991201B1

(12) United States Patent
Diggle, III

(10) Patent No.: US 6,991,201 B1
(45) Date of Patent: Jan. 31, 2006

(54) LINE SUPPORT SYSTEMS

(75) Inventor: Frederick James Diggle, III, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 130 days.

(21) Appl. No.: 10/648,889

(22) Filed: Aug. 27, 2003

(51) Int. Cl.
*A47B 96/00* (2006.01)
*A47L 3/04* (2006.01)

(52) U.S. Cl. ..... 248/229.1; 182/5; 24/136 R

(58) Field of Classification Search ..... 248/229.1, 248/925; 182/3, 5, 8; 24/136 R
See application file for complete search history.

(56) References Cited

U.S. PATENT DOCUMENTS

| | | | | | |
|---|---|---|---|---|---|
| 800,050 | A | | 9/1905 | Ayres | |
| 1,010,763 | A | * | 12/1911 | Hogan | 182/8 |
| 1,135,248 | A | * | 4/1915 | Ball | 182/5 |
| 1,479,150 | A | | 1/1924 | Mellus | |
| 2,440,469 | A | | 4/1948 | Goddard | |
| 3,144,695 | A | | 8/1964 | Budwig | |
| 3,250,515 | A | * | 5/1966 | Hundall et. al. | 242/396.5 |
| 3,289,983 | A | | 12/1966 | Mannardahi | |
| 3,357,520 | A | * | 12/1967 | Foote | 188/65.3 |
| 3,682,276 | A | * | 8/1972 | Krauss | 188/65.3 |
| 3,791,663 | A | | 2/1974 | Allsop et al. | |
| 3,861,497 | A | * | 1/1975 | Tsai | 182/5 |
| 4,019,609 | A | * | 4/1977 | Wagner | 188/65.4 |
| 4,441,233 | A | | 4/1984 | Swift | |
| 4,572,464 | A | * | 2/1986 | Phillips | 248/231.9 |
| 4,765,037 | A | | 8/1988 | Perry | |
| 4,834,327 | A | * | 5/1989 | Byrne | 248/231.9 |
| D310,716 | S | | 9/1990 | Trask | |
| 4,990,157 | A | | 2/1991 | Roberts et al. | |
| 5,038,888 | A | * | 8/1991 | Varner et al. | 182/5 |
| 5,042,113 | A | | 8/1991 | Severson et al. | |
| 5,050,273 | A | * | 9/1991 | Okura | 24/136 R |
| 5,131,491 | A | * | 7/1992 | Varner et al. | 182/7 |
| 5,150,504 | A | | 9/1992 | Cohen | |
| 6,029,870 | A | * | 2/2000 | Giacona, III | 224/148.6 |
| 6,073,315 | A | | 6/2000 | Rasmussen | |
| 6,119,993 | A | * | 9/2000 | Youngblood et al. | 248/231.9 |
| 6,648,101 | B2 | * | 11/2003 | Kurtgis | 182/3 |

OTHER PUBLICATIONS

U.S. Appl. No. 10/646,160 filed Aug. 22, 2003.
U.S. Appl. No. 10/645,950 filed Aug. 22, 2003.
U.S. Appl. No. 10/648,890 filed Aug. 27, 2003.
Carrier Handline B 0A07710, Apparatus Equipment and Tools, BellSouth Products Catalog, Jan. 2003, p. 141.

* cited by examiner

*Primary Examiner*—Anita M. King
(74) *Attorney, Agent, or Firm*—Potomac Patent Group PLLC

(57) ABSTRACT

Embodiments of the invention may include a line support system having a first and a second support member that may be elongate and form a unitary body, or separate bodies secured together, on a proximal end of the line support and are separated at a distal end of the line support. The first and second support members may be configured such that support may be provided by a biasing force at the distal end of the line support as the first support member and the second support member are resilient. The first and second support members may also be in close proximity to one another substantially along their lengths when the first and the second support members are unoccupied. The line support may also comprise a sliding retainer that may be selectively positionable about the first and second support members and configured such that the biasing force may be selectively adjustable.

11 Claims, 9 Drawing Sheets

LINE SUPPORT SYSTEMS

BACKGROUND

The subject invention generally and in various embodiments relates to line support systems, and more particularly to devices for supporting line or wire in a stable position. Hand line carriers for supporting lines or wires are generally known and used to support a line or lines to be carried by a technician. Hand line carriers are commonly attached to a technician climbing belt or body belt. These carrier devices generally release the line hanging through resilient arms of the carrier at the same amount of force regardless of the load to be supported. As such, existing hand line carriers may release line prematurely due to their construction. Another way of transporting a line or lines is for a technician to physically carry the line or lines. Yet another way is to loop the line directly through the belt of the technician.

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

SUMMARY OF THE INVENTION

In accordance with various embodiments of the invention, there may be provided a line support. The line support may have a first support member with an elongate body and a second support member with an elongate body that may be secured to the first support member at a proximal end of the line support. The first and second support members may be positioned such that support may be provided by a biasing force at a distal end of the line support as the first and second support members may be resilient. The first and second support members may be in close proximity to one another substantially along their lengths when the first and the second support members are unoccupied. The line support may also have a sliding retainer that may be selectively positionable about the first and second support members and configured such that the biasing force may be selectively adjustable.

Embodiments of the present invention may include a line support system having a first support position and a second support portion that may be elongated and form a unitary body on a proximal end of the line support and may be separated at a distal end of the line support. The first and second support portions may be configured such that support may be provided by a biasing force at the distal end of the line support as the first support portion and the second support portion may be resilient. The first and second support portions may also be in close proximity to one another substantially along their lengths when the first and the second support portions are unoccupied. The line support may also comprise a sliding retainer that may be selectively positionable about the first and second support portions and configured such that the biasing force may be selectively adjustable.

Embodiments of the present invention may also include a line support with a first and second support means for providing a biasing force. The first and second means may be capable of supporting a line as the second means may be secured to the first means on a proximal end of the line support. The first and second means may also be in close proximity to the first means substantially along their lengths when the first and second means are unoccupied. The biasing force may be applied by the first and second means due to the first and second means being resilient. The line support may further include an adjustment means for providing a selectively adjustable biasing force. The adjustment means may also be selectively positionable about the first and second means.

Other systems, methods, features, and advantages of the present invention will be or become apparent to one with skill in the art upon review of the following drawings and detailed description. It is intended that all such additional systems, methods, features, and advantages be included within this description, be within the scope of the present invention, and be protected by the accompanying claims.

BRIEF DESCRIPTION OF THE DRAWINGS

In the accompanying Figures, there are shown embodiments of the present invention wherein like reference numerals are employed to designate like parts and wherein.

DESCRIPTION

Figure 1:
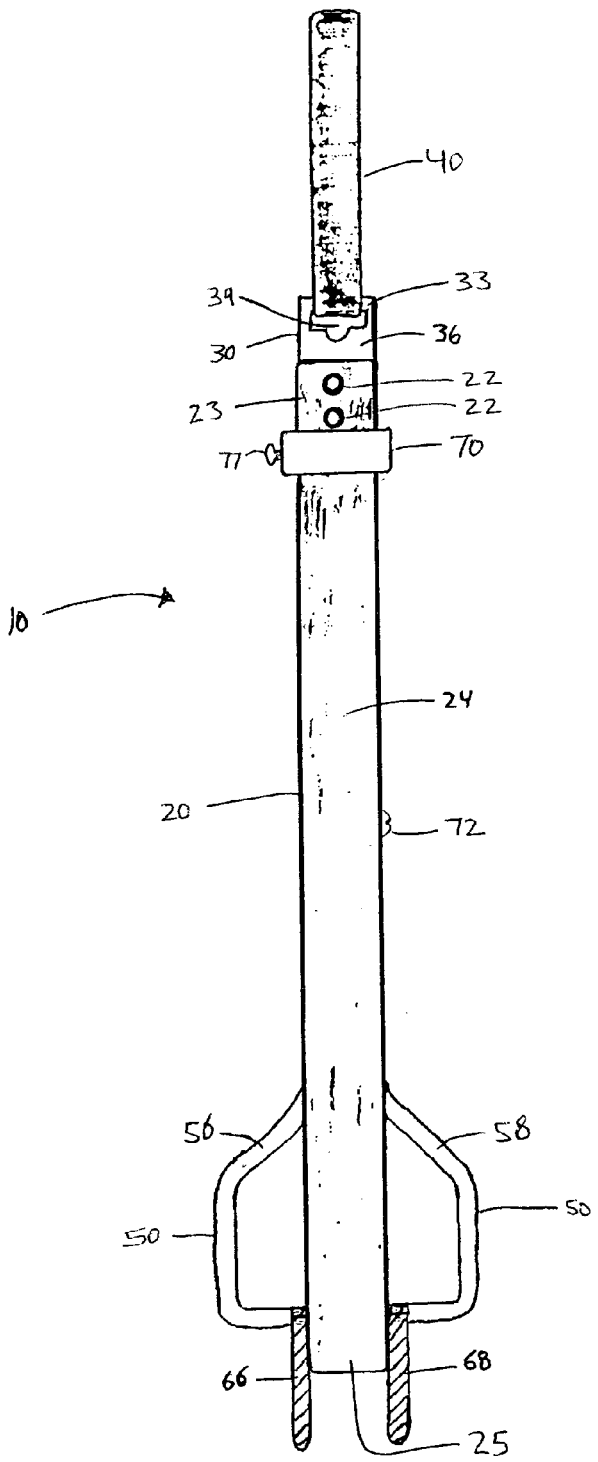
FIG. 1 is a front view of an embodiment of a line support of the present invention.

Referring now to the drawings for the purposes of illustrating embodiments of the invention only and not for the purposes of limiting the same, FIGS. 1–9 illustrate embodiments of the invention.

Figure 10:
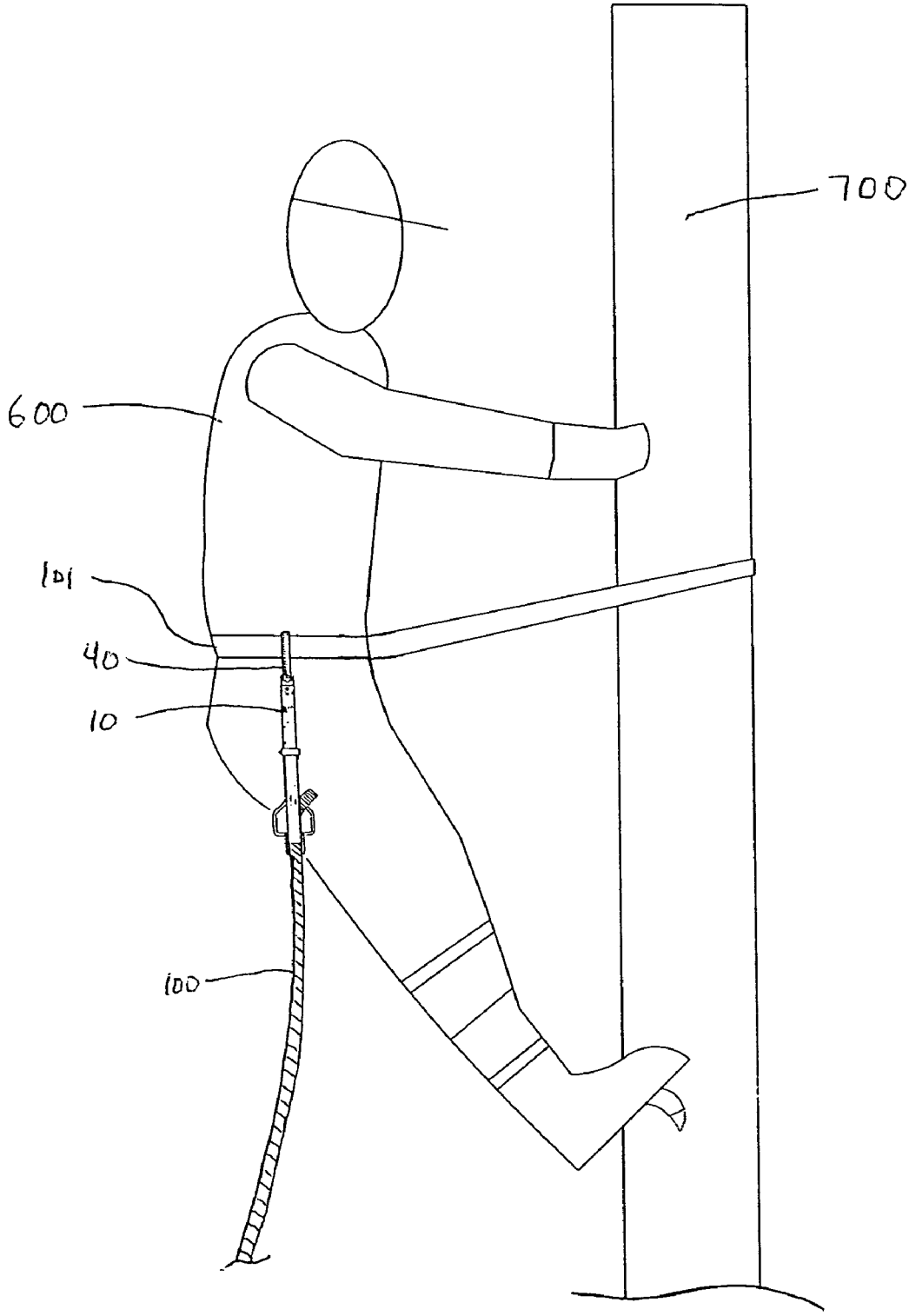
FIG. 10 is a side view of the line support of FIG. 5 as it may be employed.

FIGS. 1–5 illustrate embodiments of a line support 10. The line support 10 may include a first support member 20 and a second support member 30. The line support 10 may be optionally suspended from a loop 40 that may releasably attach to securing structures 101 such as, for example, a climbing belt, a belt loop, a body belt, etc. as shown in FIG. 10. The first support member 20 and second support member 30 may also be configured to provide support to a line 100 when the line 100 is positioned between the two support members 20, 30 or behind the first support member 20 within a stirrup 50 (or stirrup 150 shown in FIGS. 6–7).

First support member 20 may have an elongated construction and may be attached to second support member 30 by fasteners 22 at a first proximal end 23 of the first support member 20. Fasteners 22 may be constructed from various suitable materials such as, for example, bolts, rivets, etc. First support member 20 may also be in close proximity to the second support member 30 substantially along the length of the first support member 20. "Close proximity" is defined herein as being, for example, abutting or nearly abutting. First support member 20 may have a first outer surface 24 and a first inner surface 26. First inner surface 26 may be used for supporting the line 100 when the line support 10 is employed as will be discussed in greater detail below.

Second support member 30 also may have an elongated construction and may have a shank 31 and a protrusion portion 37 located on a distal portion 32 of the second support member 30. The second support member 30 may be attached to first support member 20 by fasteners 22 at a second proximal end 33 of the second support member 30. The protrusion portion 37 on the distal portion 32 is located at a second distal end 35 of second support member 30 and may also be in close proximity to the first support member 20 on the first inner surface 26 substantially along the length of the second support member 30. The phrase "substantially along the length of second support member 30" may be along most, but not all, of the length of second support member 30. The protrusion portion 37 on the distal portion 32 may be resilient. The second proximal end 33 may extend beyond the first proximal end 23 such that the second proximal end 33 may be used to provide a slot 39 for optionally attaching the loop 40. Loop 40 may have different configurations such as, for example, a rawhide strap, etc. and may or may not be needed to use the line support 10.

Figure 6:
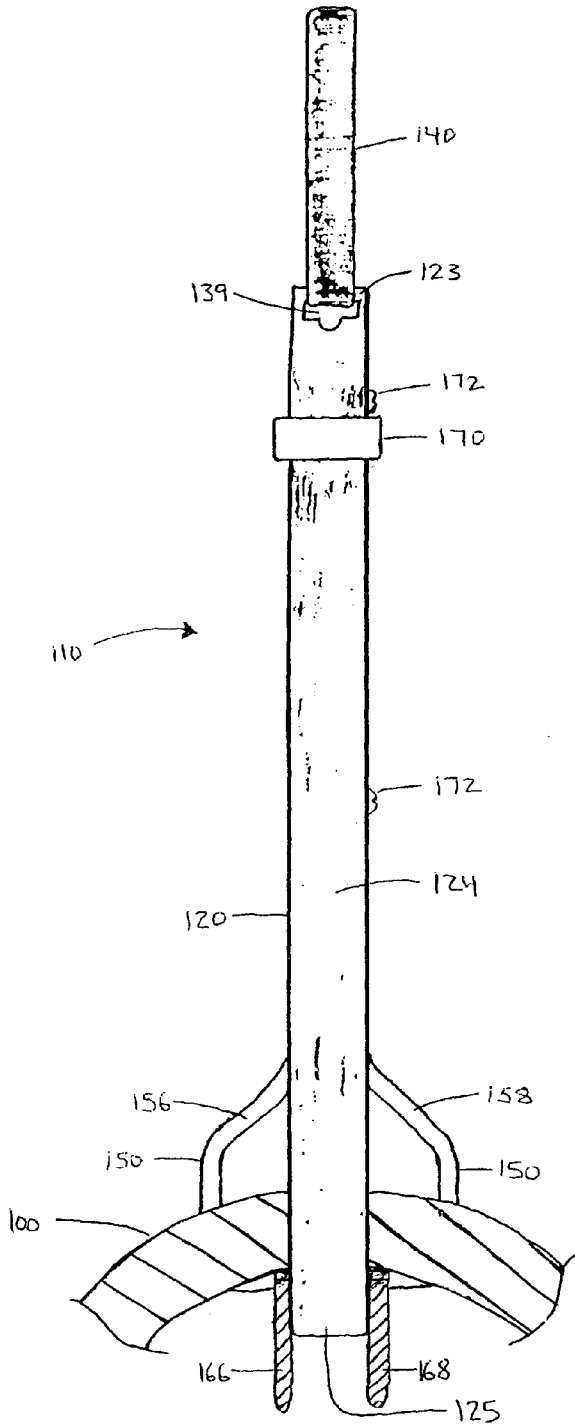
FIG. 6 is a front view of an embodiment of a line support of the present invention wherein a line may be supported.
Figure 7:
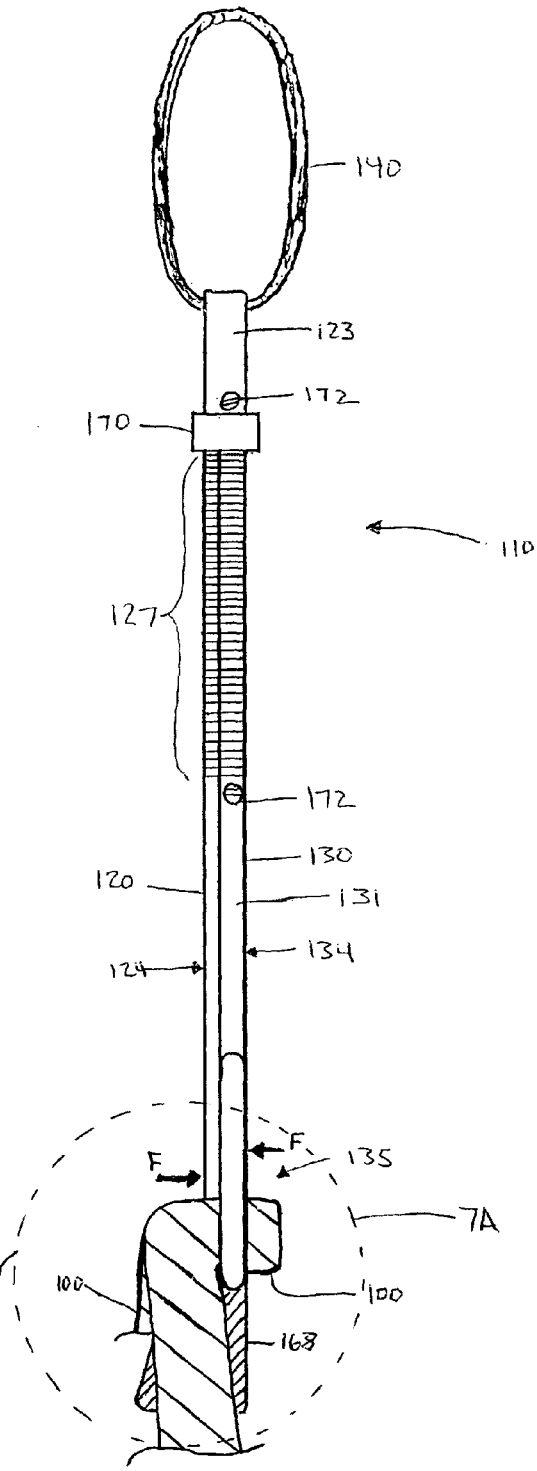
FIG. 7 is a side view of the line support of FIG. 6.

Stirrup 50 may be provided near the second distal end 35 of the second support member 30 near the end of the shank 31. A first stirrup portion 58 may be positioned on an opposite side of the second support member 30 from a second stirrup portion 56. The first and second stirrup portions 58, 56 may form a loop extending outward from the end of the shank 31 of the second support member 30 to the protrusion portion 37. Due to the configuration of the stirrup 50, vertical support may be provided to the line 100 when the line 100 is positioned behind the first support member 20 and hung through the stirrup 50 or stirrup 150 (as illustrated in FIGS. 6–7).

Alignment channels 66, 68 may also be provided at the second distal end 35 of the second support member 30. First alignment channel 68 may be positioned on an opposite side of the distal portion 32 from second alignment channel 66. The alignment channels 66, 68 may extend beyond the first and second distal ends 25, 35 of the first and second support members 20, 30, respectively. Due to the configuration and position of the alignment channels 66, 68, lateral support may be provided to the line 100 which may be secured to the line support 10 by the biasing force F. The line 100 may thus be prevented from moving side-to-side and potentially twisting out of the line support 10.

Positioned around the first and second members 20, 30 and in partial contact with the first and second outer surfaces 24, 34, may be a sliding retainer 70. The sliding retainer 70 may be of different configurations such as, for example, a slipping wedge, etc. The sliding retainer 70 may have a securing mechanism 77 such as, for example, a thumbscrew, etc. Sliding retainer 70 may be freely positioned between the fasteners 22 and a sliding retainer stop 72 when the securing mechanism 77 is disengaged. The sliding retainer 70 may be secured to one or both of the first and second support members 20, 30 by engagement of the securing mechanism 77. The closer that securing mechanism 77 may be secured to the slider retainer stop 72, the greater the biasing force F that may be available to the line support 10. Indication marks (not shown) may additionally be provided to communicate the biasing force F created for a given position of the sliding retainer 70 and may further relate the biasing force F to a number of lines or wires that can be carried up to some range of height or distance before the biasing force F would be overcome.

Figure 8:
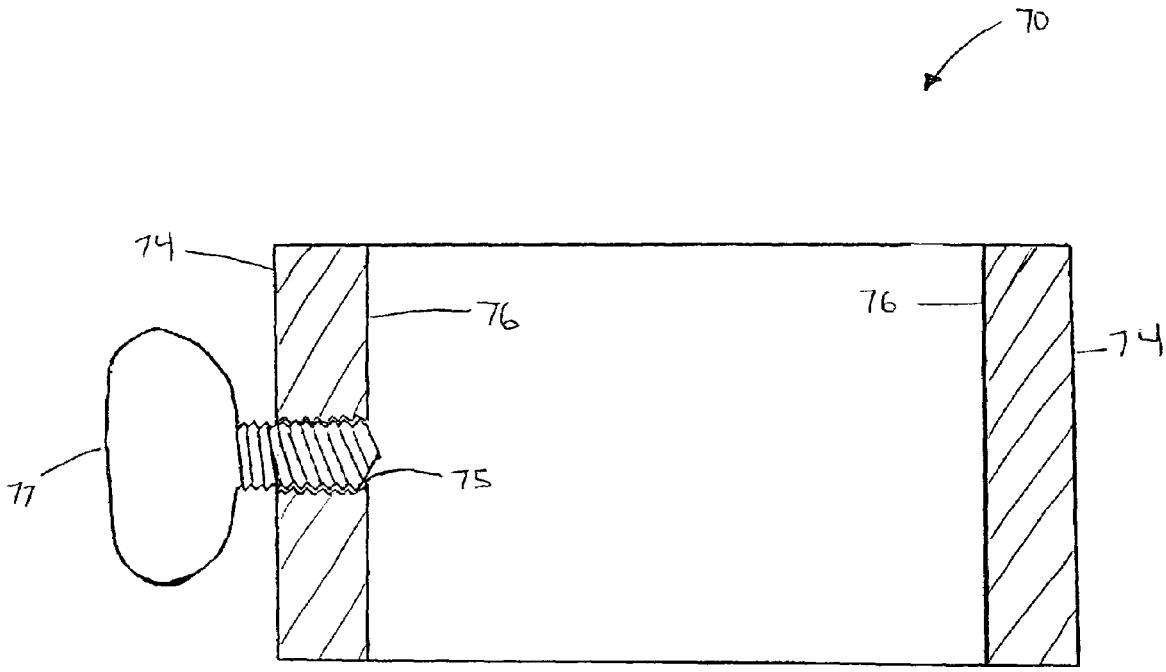
FIG. 8 is a cross section of a sliding retainer of the line support system of FIGS. 1–5.

FIG. 8 illustrates embodiments of the sliding retainer 70. As shown in FIGS. 1–5, sliding retainer 70 may be freely positioned between the fasteners 22 and sliding retainer stop 72 about the first and second members 20, 30. The sliding retainer 70 may have an inner wall 76 that may be in close proximity with the first and second outer surfaces 24, 34 and an outer wall 74. The securing mechanism 77 may be provided to be received in a threaded bore 75. When the securing mechanism 77 is tightened against one of the first and second support members 20, 30, the sliding retainer 70 will be retained in the selected position.

Figure 2:
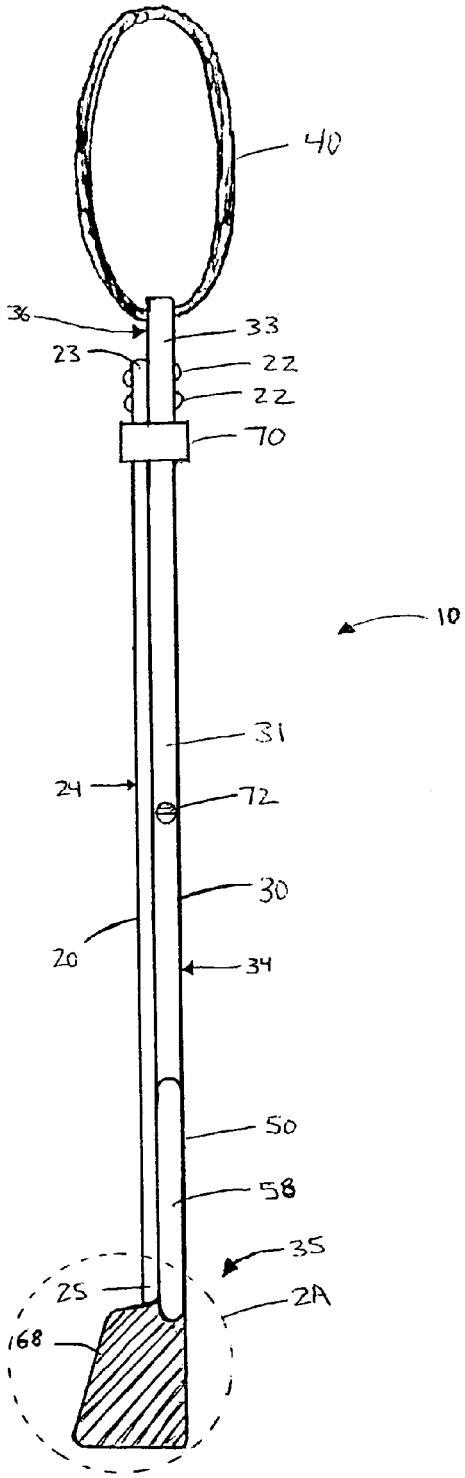
FIG. 2 is a side view of the line support of FIG. 1.
Figure 2A:
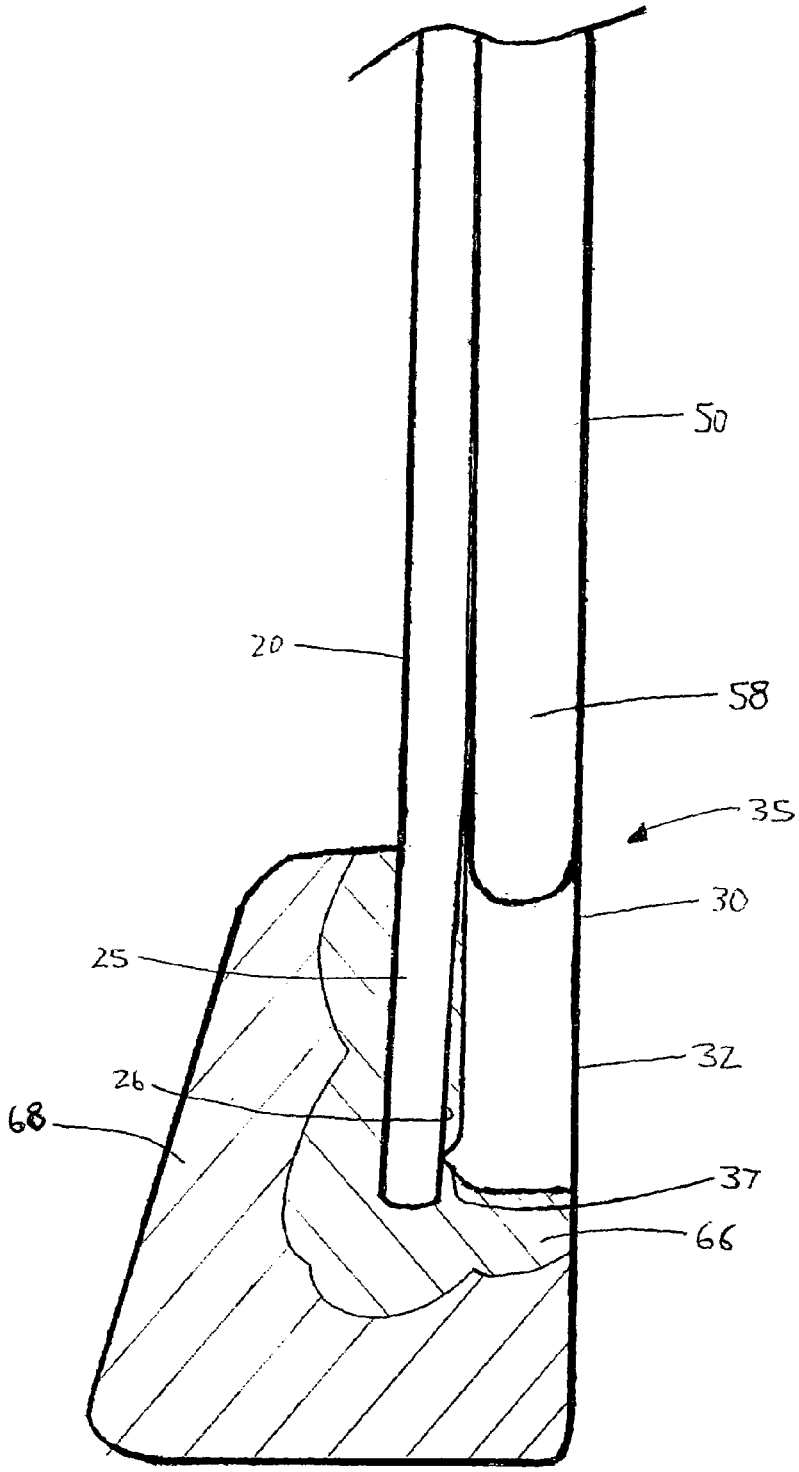
FIG. 2A is an enlarged view of an encircled portion of the line support of FIG. 2.
Figure 3:
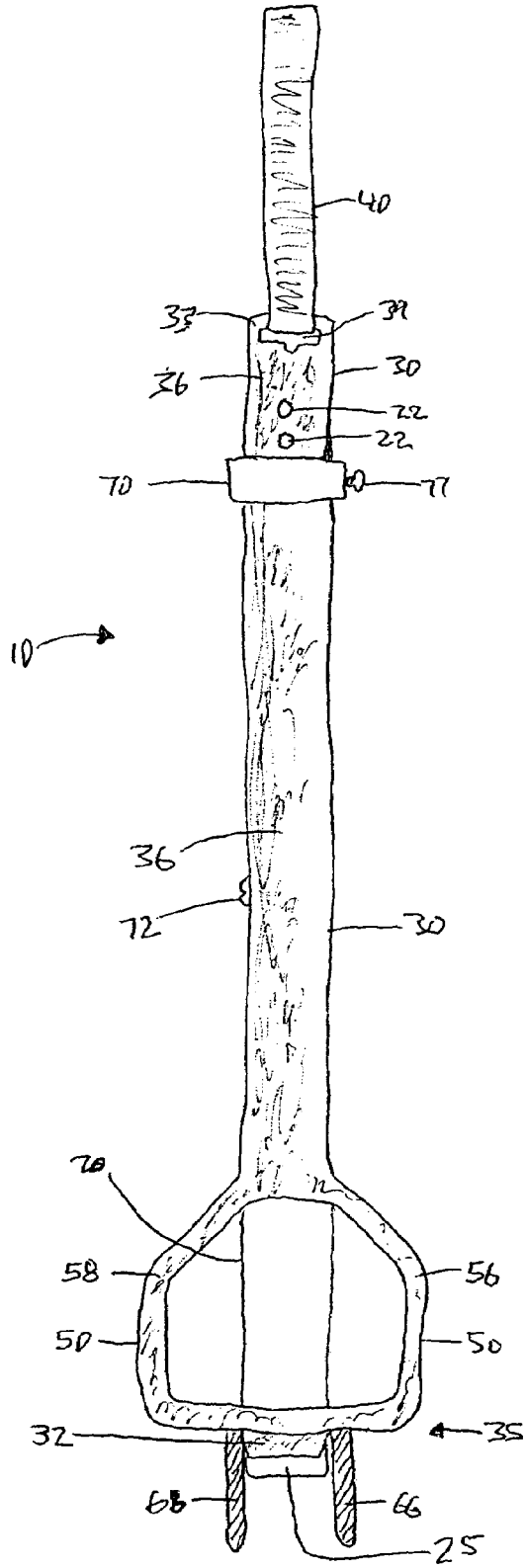
FIG. 3 is a rear view of the line support of FIG. 1.

As can be seen in FIG. 2A, the forward alignment channel 68 has a section removed for viewing purposes and the rear alignment channel 66 can be seen behind the first and second distal ends 25, 35 of the first and second support members 20, 30, respectively. The distal portion 32 on the second distal end 35 of the second support member 30 may have the protrusion portion 37 provided for being in close proximity with the first distal end 25 on the first inner surface 26. Due to the first and second proximal ends 23, 33 securing the first and second support members 20, 30 together, the first inner surface 26 of the first distal end 25 may be configured to be in close proximity to the protrusion portion 37 of the second distal end 35 when the area between the two is unoccupied. The protrusion portion 37 may be provided for increasing the grip of the biasing force F. The first and second inner surfaces 26, 36 may be in close proximity to one another substantially along their lengths, as the second support member 30 may not mirror the first support member 20, when the line support 10 is not in an open position and may otherwise be unoccupied.

Figure 4:
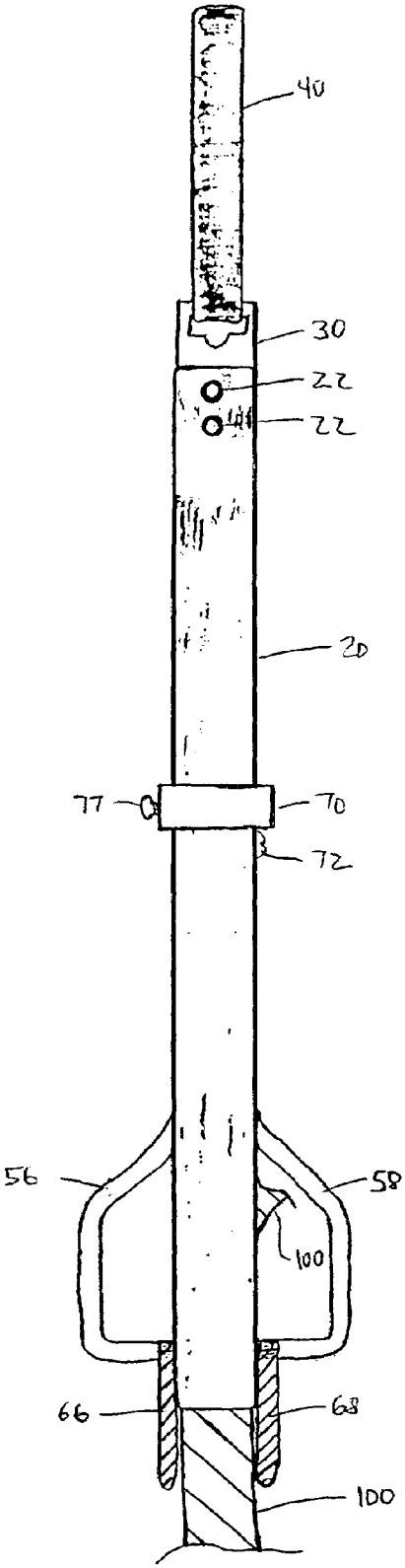
FIG. 4 is a front view of the line support of FIG. 1 wherein a line may be supported.
Figure 5:
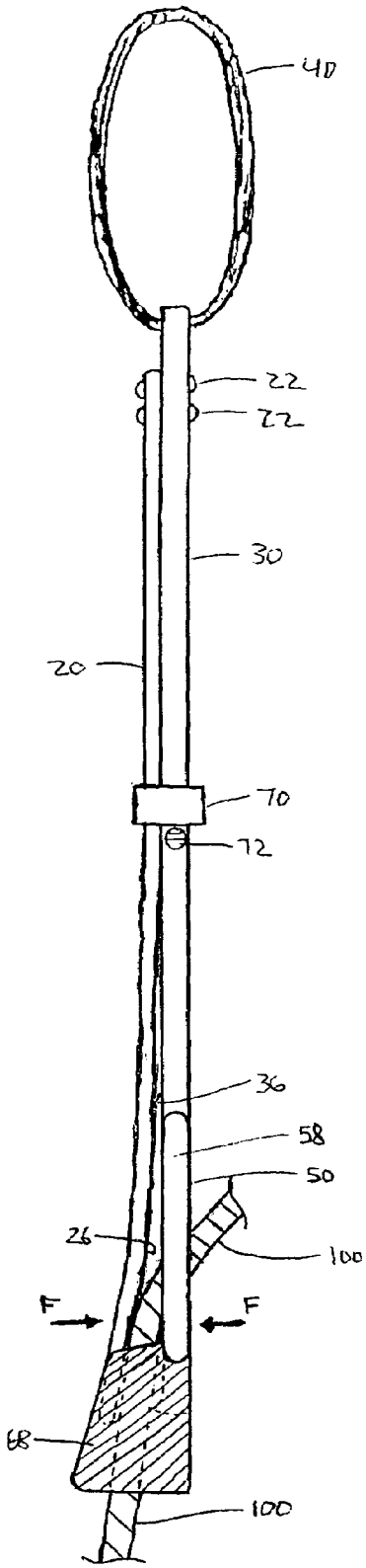
FIG. 5 is a side view of the line support of FIG. 4.

As can be seen in FIGS. 4–5, the line support 10 is employed and has the line 100 positioned between the first and second support members 20, 30. In this embodiment, the line 100 may be retained in a supported position due to the biasing force F that may be provided by the line support 10. To support the line 100, the sliding retainer 70 may be positioned at the first proximal end 23 of the first support member 20 to minimize the force F required to overcome the biasing force F. The first distal end 25 of the first support member 20 may be pried back so as to open the area between the first inner surface 26 and the protrusion portion 37. The first distal end 25 may additionally have a handle (not shown) or other structure for assisting in opposing the biasing force F by pulling the first distal end 25 away from the second distal end 35. Once the area between the first and second distal ends 25, 35 is opened, the line 100 may be fed therethrough. Thereafter the biasing force F may be reapplied by releasing the first distal end 25 of the line support 10. To increase the biasing force F, the sliding retainer 70 may be moved toward the first and second distal ends 25, 35 and secured by the securing mechanism 77. As can be seen in the drawings, sliding retainer 70 has been positioned in close proximity to the sliding retainer stop 72. As discussed above, the protrusion portion 37 may provide additional grip for the biasing force F supplied by the line support 10.

FIGS. 6 and 7 illustrate embodiments of a line support 110 of the invention as described below. The line support 110 may include a first support portion 120 and a second support portion 130. The first support portion 120 and second support portion 130 may form a unitary body at a proximal end 123 while being separated at a first distal end 125 and a second distal end 135. The line support 110 may be optionally suspended from a loop 140 that may releasably attach to securing structures 101 such as, for example, a climbing belt, a belt loop, a body belt, etc. The first support portion 120 and second support portion 130 may also be configured to provide support to the line 100 when the line 100 is positioned between the two support portions 120, 130 (as shown in FIGS. 1–5) or behind the first support portion 120 within a stirrup 150.

First support portion 120 may have an elongated construction and may form a unitary body with the second support portion 130 at the proximal end 123. First support portion 120 may also be in close proximity to the second support portion 130 substantially along their lengths. First support portion 120 may have a first outer surface 124 and a first inner surface 126. First inner surface 126 may be used for retaining the line 100 when the line support 110 is employed as will be discussed in greater detail below.

Second support portion 130 also may have an elongated construction and may have a shank 131 and a protrusion portion 137 located on a distal portion 132 of the second support portion 130. The protrusion portion 137 may also be in close proximity to the first inner surface 126 of the first support portion 120 substantially along their lengths as the first and second support portions 120, 130 may not mirror one another. The protrusion portion 137 on the distal portion 132 may be resilient. The proximal end 123 may be used to provide a slot 139 for optionally attaching the loop 140. Loop 140 may have different configurations such as, for example, a rawhide strap, etc. and may or may not be needed to use the line support 110.

Stirrup 150 may be provided near the second distal end 135 of the second support portion 130 near the end of the shank 131. A first stirrup portion 158 may be positioned on an opposite side of the second support portion 130 from a second stirrup portion 156. The first and second stirrup portions 158, 156 may form a loop extending from the end of the shank 131 of the second support member 130 to the protrusion portion 137. Due to the configuration of the stirrup 150, vertical support may be provided to the line 100 when the line 100 is positioned behind the first distal end 125 of the first support member 120 and hung through the stirrup 150.

Alignment channels 166, 168 may also be provided at the second distal end 135 of the second support portion 130. First alignment channel 168 may be positioned on an opposite side of the distal portion 132 from second alignment channel 166. The alignment channels 166, 168 may extend beyond the first and second distal ends 125, 135 of the first and second support portions 120, 130, respectively. Due to the configuration and position of the alignment channels 166, 168, lateral support may be provided to the line 100 which may be secured to the line support 110 by the biasing force F. The line 100 may thus be prevented from moving side-to-side and potentially twisting out of the line support 110.

Positioned around the first and second portions 120, 130 and in partial contact with the first and second outer surfaces 124, 134, may be a sliding retainer 170. The sliding retainer 170 may be of different configurations such as, for example, a slipping wedge, etc. The sliding retainer 170 may have a securing mechanism 177 such as, for example, a rack of teeth, etc. Sliding retainer 170 may be freely positioned between sliding retainer stops 172 when the securing mechanism 177 is disengaged. The sliding retainer 170 may be secured to one or both of the first and second support portions 120, 130 by engagement of the securing mechanism 177. The closer that securing mechanism 177 may be secured to the first and second distal ends 125, 135, the greater the biasing force F. Indication marks (not shown) may additionally be provided to communicate the biasing force F created for a given position of the sliding retainer 170 and may further relate the biasing force F to a number of lines or wires that can be carried up to some range of height or distance before the biasing force F would be overcome.

Figure 9:
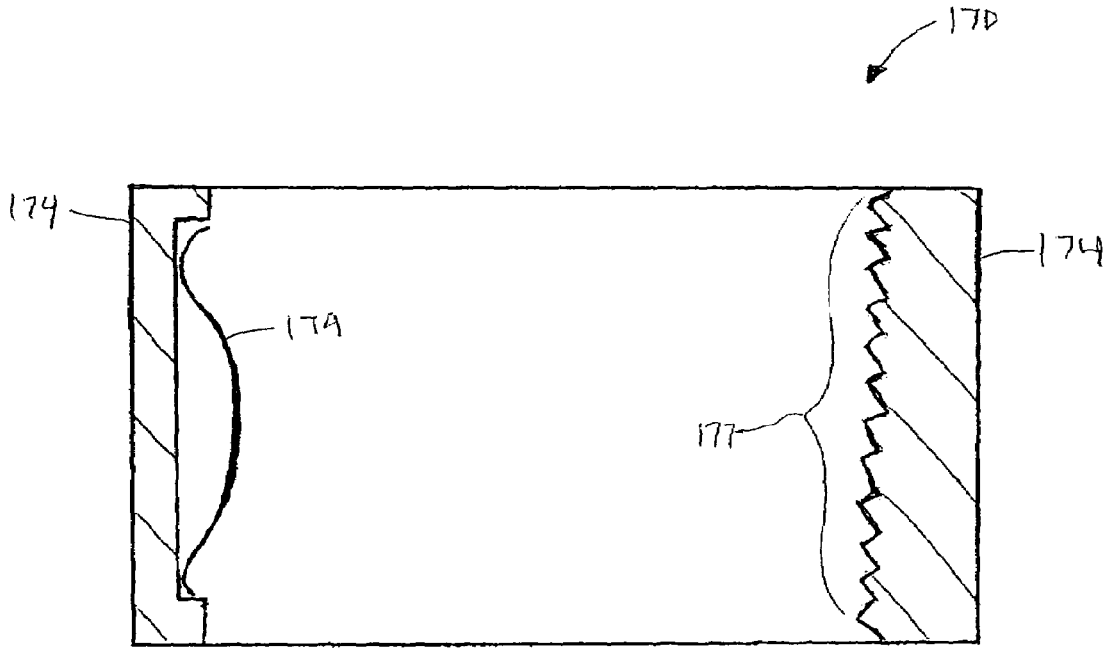
FIG. 9 is a cross section of a sliding retainer of the line support system of FIGS. 6–7.

FIG. 9 illustrates embodiments of the sliding retainer 170. As shown in FIGS. 6–7, sliding retainer 170 may be freely positioned between the sliding retainer stops 172 about the first and second portions 120, 130. The sliding retainer 170 may have an inner spring 179 that may be in close proximity with the first and second outer surfaces 124, 134 and an outer wall 174. The securing mechanism 177 may be provided in conjunction with a complementary rack of teeth 127, as illustrated in FIG. 7. When the securing mechanism 177 is engaged with the rack of teeth 127, the sliding retainer 170 may be retained in the selected position. To reposition the sliding retainer 170, the outer wall 174 may be pressed in a direction to disengage the securing mechanism 177 from the rack of teeth 127 and thus compress the spring 179. When the disengaging pressure on the outer wall 174 may be released, the sliding retainer 170 may then return to a retained position as the spring 179 forces the securing mechanism 177 to engage the rack of teeth 127.

Figure 7A:
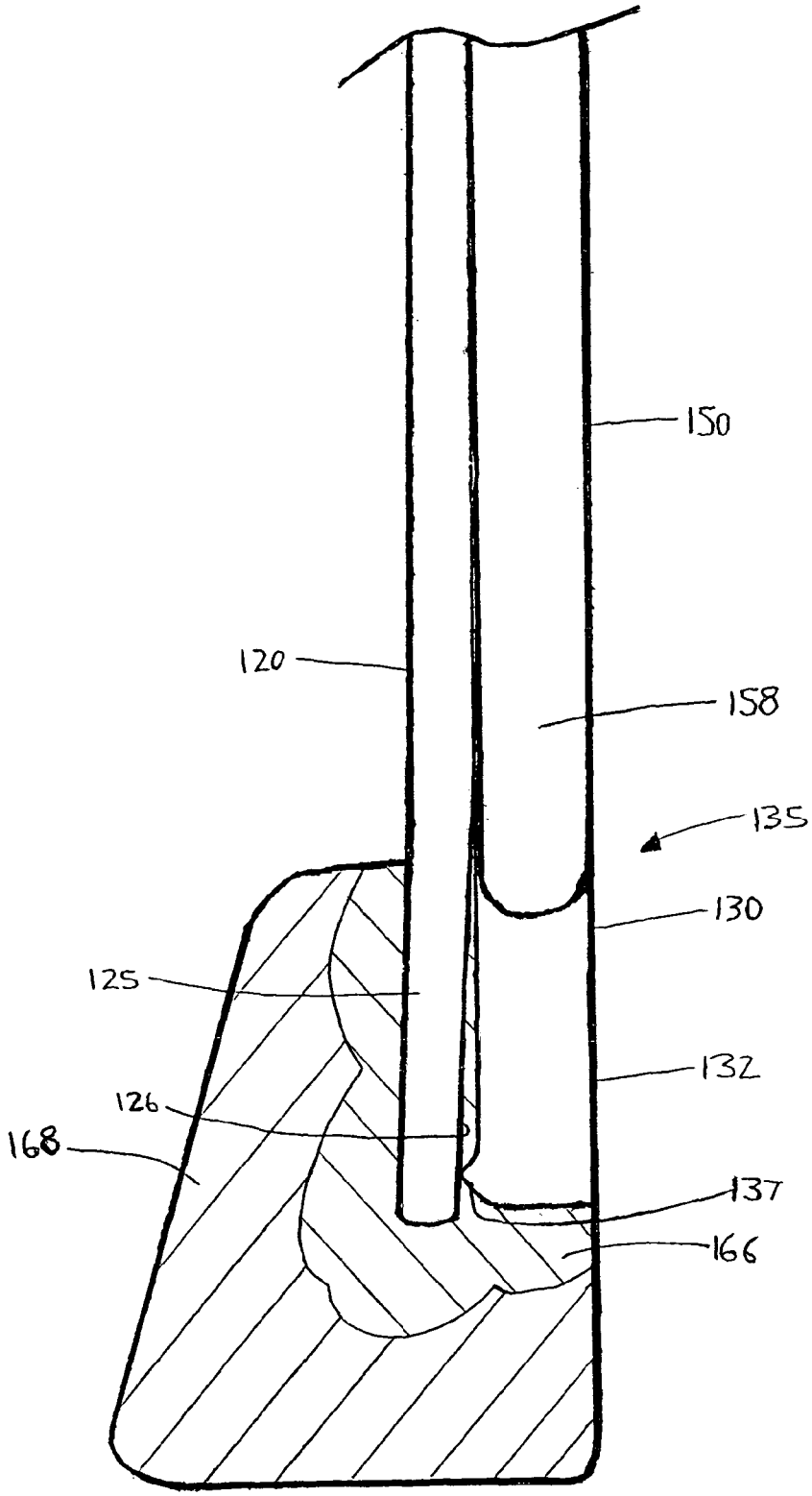
FIG. 7A is an enlarged view of an encircled portion of the line support of FIG. 7.

As can be seen in FIG. 7A, the forward alignment channel 168 has a section removed for viewing purposes and the rear alignment channel 166 can be seen behind the first and second distal ends 125, 135 of the first and second support portions 120, 130, respectively. The distal portion 132 on the second distal end 135 of the second support portion 130 may have the protrusion portion 137 provided for being in close proximity with the first distal end 125 on the first inner surface 126. Due to the proximal end 123 securing the first and second support portions 120, 130 together, the first inner surface 126 of the first distal end 125 may be configured to be in close proximity to the protrusion portion 137 of the second distal end 135 when the area between the two may be unoccupied. The protrusion portion 137 may be provided for increasing the grip of the biasing force F. The first and second inner surfaces 126, 136 may be in close proximity to one another substantially along their lengths when the line support 110 is not in an open position and may otherwise be unoccupied.

As can be seen in FIGS. 6–7, the line support 110 is employed and has the line 100 positioned behind the first support portion 120 and within the stirrup 150. In this embodiment, the line 100 may be retained in a supported position due to the biasing force F that may be provided by the line support 110. To support the line 100 in this configuration, the sliding retainer 170 may be positioned at the proximal end 123 of the line support 110. In this configuration the line 100 may be first positioned through the second stirrup portion 156 and the first support portion 120 and then positioned out through the first stirrup portion 158 and the first support portion 120. The line 100 that may be protruding from between the first stirrup portion 158 and the first support portion 120 may then be allowed to droop a given length depending on the requirements of the carrier. In this configuration, absent the line 100 slipping out of the position behind the first support portion 120, the biasing force F may retain the line 100 in the line support 110. To increase the biasing force F, the sliding retainer 170 may be moved toward the first and second distal ends 125, 135 and secured by the securing mechanism 177.

FIG. 10 illustrates the line support 10 as it may be in use with a lineman 600 on a pole 700. As discussed above, the line 100 may be positioned through the line support 10 and may thus be supported therein. The line support 100 may further be optionally suspended from the loop 40 that may releasably attach to the securing structure 101. As can be seen in the drawing, the lineman 600 is free to work while strapped onto the pole 700 while having the line 100 conveniently positioned and supported.

Other methods of attaching the line supports 10, 110 are, within the spirit and scope of the embodiments of the invention. The line supports 10, 110 may attach directly to a belt or other securing structure. In addition, the line supports 10, 110 may also be carried by hand or otherwise configured to attach to different securing structures.

Further implementations for allowing the line supports 10, 110 to open for positioning the line 100 to allow the biasing force F to be applied are within the spirit and scope of the invention as well. The addition of an extra length of the first support 20, 120 beyond the second support 30, 130 may be implemented for this purpose, as well as other like implementations may be used to assist in the separation of the first support 20, 120 from the second support 30, 130.

The distal portion 32, 132 of the second support 30, 130 may also be shaped in a myriad of different shapes to provide increased grip for the biasing force F. Also, protrusion portion 37, 137 may be positioned on the first support 20, 120. Other shapes and designs may be employed for increasing grip on the line 100 when the line support 10, 110 is employed.

The embodiments of the invention represent significant improvements over line carrying devices. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A line support, comprising:

a first support member having an elongate body;

a second support member having an elongate body, the first and second support members secured to one another at a proximal end of the line support and positioned such that support is provided by a biasing force at a distal end of the line support wherein the first and second support members are resilient, and wherein the first and second support members are in close proximity to one another substantially along their lengths when the first and the second support members are unoccupied, wherein the second support member further comprises at least two alignment channels positioned at a distal end of the second support member and extending beyond the second support member; and a sliding retainer selectively positionable about the first and second support members and configured such that the biasing force is selectively adjustable.

2. The line support of claim 1, further comprising at least one protrusion provided at a distal end of at least one of the first and second support members and capable of increasing grip of the biasing force.

3. The line support of claim 1, wherein the second support member further comprises at least one stirrup portion positioned at a distal end of the second support member and extending laterally outward from the second support member and forming a loop.

4. The line support of claim 1, wherein at least one of the first and second support members has an attachment mechanism capable of attaching the line support to a securing structure.

5. The line support of claim 1, wherein said first and second support members form a unitary body at said proximal end of the line support and separate portions at said distal end of the line support.

6. A line support, comprising:

a first support member having an elongate body;

a second support member having an elongate body, the first and second support members secured to one another at a proximal end of the line support and positioned such that support is provided by a biasing force at a distal end of the line support wherein the first and second support members are resilient, and wherein the first and second support members are in close proximity to one another substantially along their lengths when the first and the second support members are unoccupied; and a sliding retainer selectively positionable about the first and second support members and configured such that the biasing force is selectively adjustable, wherein the sliding retainer has a threaded bore therethrough for engagement with a securing mechanism that engages at least one of the first and second support members and is capable of retaining the sliding retainer in a selected position.

7. A line support, comprising:

a first support member having an elongate body;

a second support member having an elongate body, the first and second support members secured to one another at a proximal end of the line support and positioned such that support is provided by a biasing force at a distal end of the line support wherein the first and second support members are resilient, and wherein the first and second support members are in close proximity to one another substantially along their lengths when the first and the second support members are unoccupied; and a sliding retainer selectively positionable about the first and second support members and configured such that the biasing force is selectively adjustable, wherein the sliding retainer has teeth members for engagement with at least one of the first and second support members and wherein the sliding retainer is releasably biased in a selectable retained position.

8. The line support of claim 7, wherein at least one of the first and second support members has a rigid surface for engagement with the teeth members of the sliding retainer.

9. A line support, comprising:

a first support member having an elongate body;

a second support member having an elongate body, the first and second support members secured to one another at a proximal end of the line support and positioned such that support is provided by a biasing force at a distal end of the line support wherein the first and second support members are resilient, and wherein the first and second support members are in close proximity to one another substantially along their lengths when the first and the second support members are unoccupied; and a sliding retainer selectively positionable about the first and second support members and configured such that the biasing force is selectively adjustable, wherein the first support member further comprises a handle located at a distal end of the first support member wherein the handle is configured to assist in opposing the biasing force when pulled.

10. A line support comprising:

a first support member having an elongate body;

a second support member having an elongate body, the first and second support members secured to one another at a proximal end of the line support and positioned such that support is provided by a biasing force at a distal end of the line support wherein the first and second support members are resilient, and wherein the first and second support members are in close proximity to one another substantially along their lengths when the first and the second support members are unoccupied; and a sliding retainer selectively positionable about the first and second support members and configured such that the biasing force is selectively adjustable, wherein at least one sliding retainer stop is provided and positioned to prevent the sliding retainer from being maneuvered past the at least one sliding retainer stop.

11. A line support, comprising:

a first support member having an elongate body;

a second support member having an elongate body, the first and second support members secured to one another at a proximal end of the line support and positioned such that support is provided by a biasing force at a distal end of the line support wherein the first and second support members are resilient, and wherein the first and second support members are in close proximity to one another substantially along their lengths when the first and the second support members are unoccupied; and a sliding retainer selectively positionable about the first and second support members and configured such that the biasing force is selectively adjustable, wherein at least one of the first and second support members provide indicators that relate to the amount of biasing force provided for a given position of the sliding retainer.

* * * * *